US005557058A

United States Patent [19]

Lace

[11] Patent Number: 5,557,058

[45] Date of Patent: Sep. 17, 1996

[54] SIGNAL BLENDER FOR THREE OR MORE MUSICAL INSTRUMENT PICKUPS

[75] Inventor: Melvin A. Lace, Prospect Heights, Ill.

[73] Assignee: Thomas E. Dorn, Clarendon Hills, Ill.; a part interest

[21] Appl. No.: 329,315

[22] Filed: Oct. 26, 1994

[51] Int. Cl.[6] ..... G10H 1/08; G10H 3/12; H01C 10/34; H01C 10/36

[52] U.S. Cl. ..... 84/735; 338/73

[58] Field of Search ..... 84/697, 698, 735; 338/73

[56] References Cited

U.S. PATENT DOCUMENTS 1,929,032 10/1933 Miessner et al. ..... 84/698

2,960,605 11/1960 Montz ..... 338/73 X 3,251,016 5/1966 Manetti et al. ..... 338/73

*Primary Examiner*—Stanley J. Witkowski

*Attorney, Agent, or Firm*—Dorn, McEachran, Jambor & Keating

[57] ABSTRACT

A signal blender that combines the pickup signals generated by three pickups for a musical instrument (e.g., a guitar) in plural combinations and multiple amplitudes to develop a blend signal. The device comprises a main blending resistance with plural connection taps, one for each pickup when the main resistance is a complete 360° ring, one more tap if the main resistance is less than 360°. Each pickup is connected to a tap. A rotary contact engages the main resistance to generate the blend signal; the blend signal is applied to an output amplifier.

20 Claims, 4 Drawing Sheets

SIGNAL BLENDER FOR THREE OR MORE MUSICAL INSTRUMENT PICKUPS

BACKGROUND OF THE INVENTION

1. Field of the Invention

This invention is concerned with a signal blender circuit and device for combining the pickup signals from three or more pickups on one musical instrument (e.g., a guitar) in varying combinations and amplitudes to achieve a composite signal acceptable to the instrument player.

2. Description of the Prior Art

For many musical instruments used to generate signals for electrical amplification it has been conventional practice to employ plural electromagnetic pickups mounted at different locations on the instrument. In electrical guitars, for example, two or three pickups have frequently been employed. The output signals from these pickups are blended to generate a blend signal that is amplified and reproduced by one or more speakers. Because the pickups may not produce outputs of equalized amplitude, and because the performer using the instrument may desire to emphasize the signals from one or more pickups relative to others, the blending procedure is often essential and critical with respect to the musical performance.

The conventional system used to mix signals from two or more pickups consists of a switch which connects the pickups in parallel so as to mix pickups No. 1 and No. 2 or No. 2 and No. 3. The No. 1 and No. 3 pickups are almost never connected together by this switch system. The standard method to mix has used a five position switch of the shorting type. Position No. 1 for the switch uses the output from only pickup No. 1. Switch position No. 3 uses the second pickup alone. Switch position No. 5 has the third pickup by itself. Switch position No. 2 connects the first and second pickups together, thus mixing the two. Position No. 4 of the switch connects pickups two and three together, thus mixing them. The amount of mixing or the percentage of mixing, pickup 1 vs. pickup 2 or pickup 2 vs. pickup 3, is usually fixed at 50/50 and cannot be changed.

A variable resistor system has been used to mix two pickups by connecting each pickup to one end of a variable resistor and connecting the slider to the output to afford a blend signal. This resistive type of mixing makes it possible to vary the blend, but only allows for mixing two pickups. These systems have employed pots that are of conventional construction and can rotate just 270 degrees.

SUMMARY OF THE INVENTION

It is an object of the invention, therefore, to provide a new and improved signal blender that affords more versatile blending of plural pickup signals from a musical instrument to develop a composite blend signal therefrom.

Another object of the invention is to provide a new and improved signal blender that can be accurately and quickly adjusted to afford a composite blend signal in which output signals from a plurality of musical instrument pickups, usually three or more, are combined in different amplitude ratios to suit the desires of a performer.

A further object of the invention is to provide a new and improved blender for musical instrument pickup signals that is simple and inexpensive to manufacture yet highly reliable in operation.

Accordingly, the invention relates to a signal blender for blending the pickup signals generated by at least three musical instrument pickups in a plurality of different combinations and in a multiplicity of different amplitudes to develop a blend signal. The signal blender of the invention comprises a continuous main blending resistance having at a plurality of main connection taps, at least one for each pickup. There are a plurality of main connection means, at least one main connection means for each pickup, connecting each pickup to at least one main resistance connection tap. A main movable electrically conductive contact, engageable in electrical contact with the main resistance at any point on the main resistance, is utilized to derive a blend signal therefrom. The signal blender further includes output connection means connecting the main movable contact to an output circuit to apply the blend signal to the output circuit.

In regard to FIGS. 1, 3, 4 and 5 the foregoing designation of each as a "plan view" is quite arbitrary; the orientation of the device may be varied, as by a performer using a musical instrument, so that any of these figures may constitute an elevation view or something intermediate a plan view and an elevation view.

DESCRIPTION OF THE PREFERRED EMBODIMENTS

Figure 1:
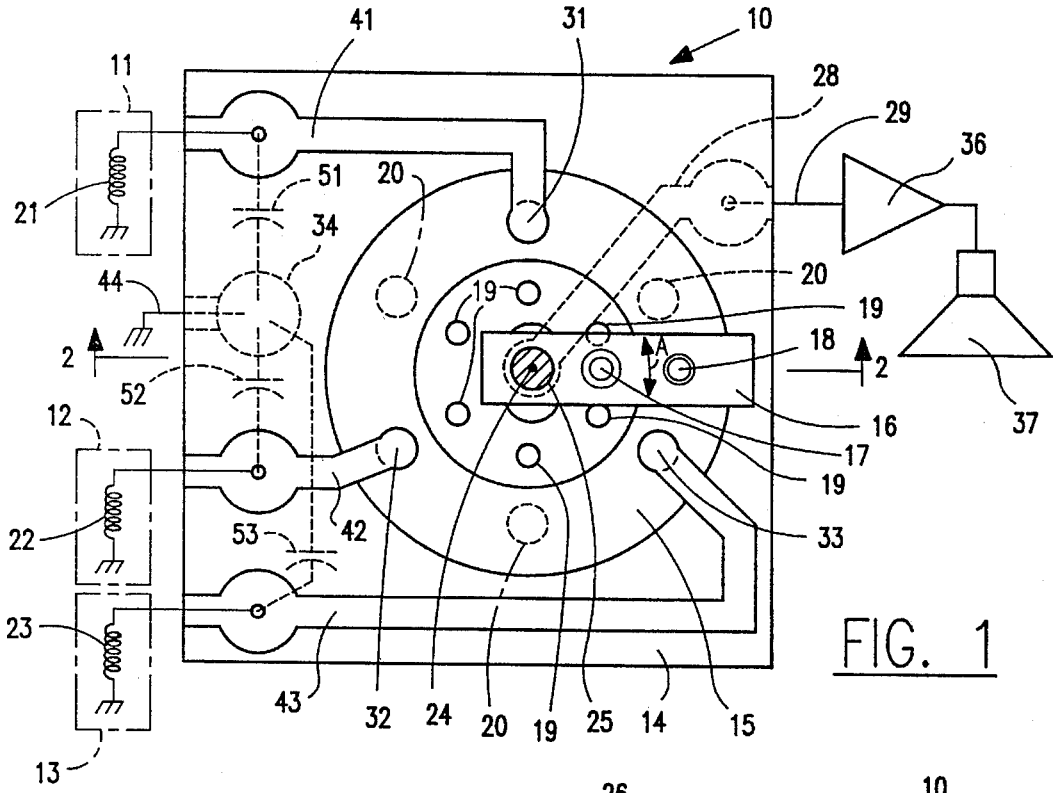
FIG. 1 is a plan view of a signal blender constructed in accordance with one embodiment of the invention.
Figure 2:
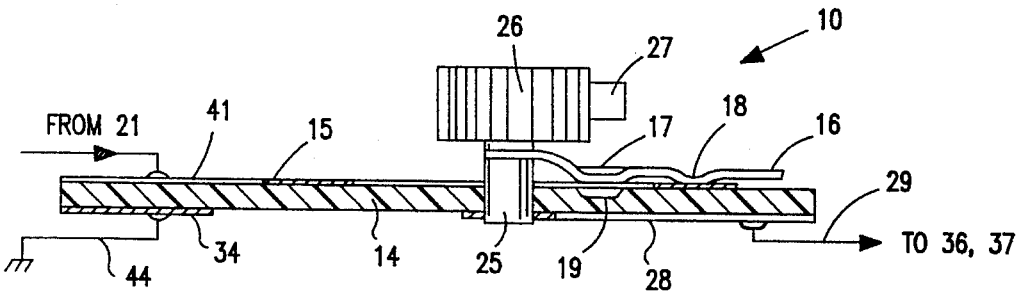
FIG. 2 is a sectional elevation view taken approximately along line 2—2 in FIG. 1.

FIGS. 1 and 2 illustrate a signal blender 10 constructed in accordance with one embodiment of the present invention. Blender 10 is utilized to blend the pickup signals generated by three musical instrument pickups 11, 12 and 13 in a plurality of different combinations and in a multiplicity of different amplitudes to develop a blend signal that is applied to an amplifier 36 to drive a speaker 37. Typically, the three musical pickup devices 11, 12 and 13 are all mounted on one guitar. The player of the guitar or other musical instrument may find it necessary or desirable to combine the outputs of any two of the pickups in varying amplitudes in order to achieve the overall musical effects that the player desires. The electromagnetic coils in the pickups that actually generate the pickup signals are identified, in FIG. 1, by reference numerals 21, 22, and 23 respectively.

Signal blender 10 of FIGS. 1 and 2 includes a support 14, shown as a segment of a printed circuit board. Board 14 is shown larger than its actual size. Typically, support 14 may comprise a square segment of printed circuit board having dimensions of approximately 1 inch (2.5 cms) on each side and a thickness of about 0.125 inch (0.3 cm). Much of one surface of support 14 shown in FIG. 1 is occupied by a continuous main blending resistance 15. An appropriate material for the main blending resistance 15 is a polyfilm resistance material having a resistance of 150,000 ohms per square. Other resistance materials may be used; a range of 10 to 150 kilohms per square is appropriate.

Blender 10 further comprises a plurality of main connection taps or terminals, shown as the electrical connections 31, 32 and 33 on the main blending resistance 15. As shown in FIG. 1, taps 31–33 are preferably located at equal angular distances from each other around the annular resistance 15. That is, taps 31–33 are angularly spaced from each other by 120°. In the construction shown in FIGS. 1 and 2 there is one tap for each musical instrument pickup 11–13.

Blender 10 further comprises a plurality of main connection means 41, 42 and 43 located on the same surface of the printed circuit support 14 as the main blending resistance ring 15. In the embodiment of FIGS. 1 and 2, there is one connection means 41–43 for each pickup 11–13. Connection means 41, which may comprise a conductive plating on the top surface of support 14, affords an electrical connection from one end of the coil 21 of pickup 11 to the first connection tap 31 of the blender. Similarly, main connection means 42 is a conductive strip that connects tap 32 to one end of the coil 22 in pickup 12. Conductor 43 affords an electrical connection from tap 33 to one end of the coil 23 in electrical pickup 13. In each of the pickups 11–13, the end of the operating coil opposite the connection to blender 10 is grounded.

Blender 10 further comprises a main electrically conductive contact 16 that is rotatably movable about the axis 24 of the main resistance ring 15. As can best be seen in FIG. 1, the main movable contact 16 is electrically engageable in contact with the main resistance 15 at any point around the entire main resistance. Contact 16 is preferably formed of a resilient, electrically conductive material such as a tempered strip of thin copper or bronze metal. A depression 18 is formed in contact 16, in alignment with the main resistance 15, in order to afford a firm electrical connection to the ring-shaped main resistance. The movement of contact 16 is indicated, in FIG. 1, by arrows A.

Blender 10 further comprises an output connection means 28 that is electrically connected to contact 16 at the shaft 25, as shown in FIGS. 1 and 2. This output connection means 28 may comprise a conductor plated on the opposite surface of base 14 from the main resistance ring 15. A conductor 29 connects the output connection 28 to the input of an amplifier 36. Amplifier 36 drives a speaker 37. It will be recognized that amplitude and tone controls and other controls may be provided for amplifier 36 and speaker 37; since those controls form no part of the present invention, they have not been shown in FIGS. 1 or 2.

As best shown in FIG. 1, the inner edge of the main resistance ring 15 has a constant displacement from axis 24. A series of depressions 19 in the upper surface of PC board 14 (see FIG. 2) are located at equal angular positions and at a smaller displacement from axis 24 than the displacement of ring 15 from the axis. Each of these detent depressions or 19 is of a size to receive a male detent member 17 formed by deformation of the resilient metal contact 16. In the preferred arrangement illustrated in FIG. 1, there is one female detent depression 19 aligned with each of the main connection taps 31, 32, and 33. In addition, there are three more detent depressions 19 in board 14, each located equal-angularly between two of the main connection taps.

This detent arrangement is a major convenience for the person using blender 10. It enables that person to align contact 16 at any one of six different positions around the main resistance ring 15 without having to look at the blender. The number of detent depressions 19 may be increased or decreased as desired. A knob 26 is mounted on shaft 25, the shaft for rotatable contact 16, as shown in FIG. 2, to allow the user of blender 10 to rotate main contact 16 to any of the six different preset detent positions without looking at the blender. There is an indicator projection 27 on knob 26 to assist the user in alignment of the main movable contact 16. In FIG. 1, contact 16 is shown at a position intermediate the detent positions. The phantom outlines 20 in FIG. 1 identify the positions of the electrical contact 18 on contact member 16 relative to main resistance 15 when contact 16 is aligned at one of the between-tap detent positions defined by depressions 19.

In many musical instrument pickups, a capacitor is connected in parallel with the pickup coil. However, it may be desirable to incorporate those capacitors, or additional capacitors, in the overall assembly constituting blender 10. To this end, a ground contact 34 is disposed on the surface of support 14 opposite the surface on which the main resistance 15 and the connection conductors 41–43 are disposed. Contact 34 is shown to have a ground connection 44. In the three-pickup blender 10, a capacitor 51 is shown connected from contact 34 through support 14 to connection conductor 41 (FIG. 1). Similarly, a capacitor 52 is shown connected from ground contact 34 to the main connection means comprising conductor 42, and a third capacitor 53 is connected from ground contact 34 to the remaining main connection conductor 43.

Figure 1A:
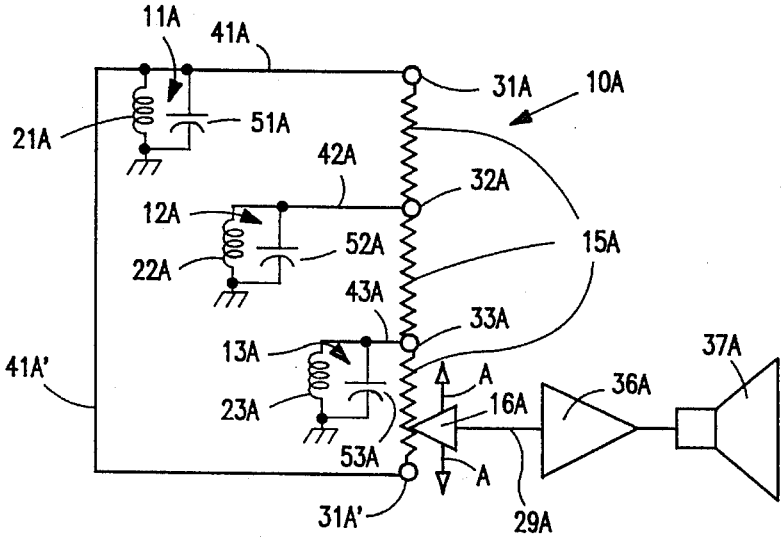
FIG. 1A is a schematic electrical diagram of an equivalent circuit for the blender of FIGS. 1 and 2.

FIG. 1A affords an equivalent circuit 10A for blender 10 of FIGS. 1 and 2. In FIG. 1A, circuit elements of the blender are shown with the same reference numerals as in FIGS. 1 and 2, except that the letter "A" has been added to each reference numeral. Thus, in the equivalent circuit diagram 10A the output coil 21A of pickup 11A is electrically connected by a conductor 41A to one connection tap 31A of a series-connected main resistance 15A representative of the main blender resistance 15. Because the series resistance 15A is shown linearly rather than circularly, in FIG. 1A, an additional tap 31A' is shown at the bottom of FIG. 1A; tap 31A' is connected to coil 21A by a conductor 41A'. The coil 22A of pickup 12A is connected by a conductor 42A to the tap 32A on resistance 15A. For the third pickup 13A, the coil 23A is electrically connected by a conductor 43A to the tap 33A on the blending resistance. Capacitors 51A, 52A, and 53A are shown electrically connected in parallel with coils 21A, 22A, and 23A, respectively; the lower terminal of each of the pickup coils is grounded.

In FIG. 1A, the movable contact 16A is shown schematically. It is movable in the directions indicated by the arrow A to provide an electrical contact at any point along the length of the main resistance indicated by the resistor chain 15A. The output from movable contact 16A is connected, through a conductor 29A, to the amplifier 36A that drives speaker 37A.

Operation of blender 10 can most easily be considered by reference to the operation of its equivalent circuit 10A, FIG. 1A. With movable contact 16A located at the position shown in FIG. 1A, the predominant signal picked up by movable contact 16A through its contact with the lower segment of the main resistance 15A is derived from pickup 11A due to the electrical connection of pickup coil 21A to tap 31A'. However, there is some contribution from pickup 13A to the blend signal output on conductor 29A, since contact 16A is engaged with a portion of the lower segment of resistance 15A between taps 31A' and 33A. Moving the blender contact 16A down from its position shown in FIG. 1A into engagement with tap 31A' effectively eliminates two pickups 12A and 13A from contributing to the blend signal, because there is now a direct connection of contact 16A to pickup 11A through tap 31A'.

Movement of contact 16A upwardly from the position shown in FIG. 1A, however, changes the blend signal substantially. Thus, as movable contact 16A approaches tap 33A, the output signal from pickup 13A becomes predominant in the blend signal derived by contact 16A and supplied to amplifier 36A through conductor 29A. When contact 16A reaches tap 33A, the only signal supplied to amplifier 36A and speaker 37A is the signal from pickup 13A. With continuing upward movement of contact 16A beyond tap 33A, in the equivalent circuit 10A of FIG. 1A, the output signal from pickup 12A is introduced into the blend signal and becomes more and more predominant until finally that is the only signal supplied to amplifier 36A. This condition is reached when movable contact 16A reaches tap 32A. Further upward movement of contact 16A decreases the predominance of the output signal from coil 22A of pickup 12A and begins to introduce more and more of the pickup signal from coil 21A of pickup 11A into the blend signal being supplied to amplifier 36A. Finally, when movable contact 16A reaches the top of FIG. 1A and engages tap 31A, the same condition applies as when the movable contact was engaged with tap 31A'. That is, when contact 16A reaches tap 31A the only signal it supplies to amplifier 36A is the signal from pickup 11A. For this condition the other two pickups 12A and 13A do not contribute to the blend signal conductor 29A supplies to amplifier 36A to drive speaker 37A.

From this operational description it will be apparent that blender 10, as represented by its equivalent circuit 10A, blends the pickup signals from the three musical instrument pickups 11, 12 and 13 in a plurality of different combinations and in a multiplicity of different relative amplitudes. Starting the movement of contact 16A from the bottom of FIG. 1A, only the signal from pickup 11A is supplied to amplifier 36A. With upward movement of contact 16A, the signal supplied to amplifier 36A is a blend of the pickup signals from pickups 11A and 13A. When contact 16A engages tap 33A, the only signal supplied to amplifier 36A is the third pickup signal from device 13A. Between taps 33A and 32A the continuing upward movement of contact 16A provides a blend, in varying amplitudes, of the pickup signals from devices 12A and 13A. At tap 32A, of course, contact 16A supplies only the output from pickup coil 22A to amplifier 36A. Above tap 32A the blend signal is again a mixture of pickup signals, this time the signals from pickup coils 22A and 21A. Finally, when contact 16A reaches tap 31A, the cycle is complete and the output signal to amplifier 36A is again only the output from coil 21A of pickup 11A. In the circular arrangement of FIG. 1, of course, taps 31A and 31A' are physically the same. It is thus seen that the sequence of the blend signals for clockwise motion of contact 16, starting with the rotary contact at TAP 31, may be stated as 11/11+13/13/13+12/12/12+11/11. It will be recognized that the same sequence expressed in reverse is equally applicable, with the circular arrangement illustrated in FIG. 1, if the motion of contact 16 is counter-clockwise instead of clockwise.

If it were assumed that the pickup signals from each of the three musical instrument pickups 11, 12 and 13 were all the same, it would seem that blender 10 has minimal utility. However, the three pickup signals are often markedly different from each other. To begin with, pickups 11, 12 and 13 cannot possibly be all located at the same position on the musical instrument. The differences in positions between the three will almost certainly result in some differences in the pickup signal that each produces. Furthermore, for special effects the player of the musical instrument may decide to utilize different size capacitors for capacitors 51, 52 and 53, shown in FIG. 1A as capacitors 51A, 52A and 53A. Thus, the tuning (frequency characteristic) for each pickup is liable to be substantially different. Finally, there is no assurance that the operating characteristics of the three pickups 11, 12 and 13 are truly identical. If different types of pickups are used the differences are likely to be quite prominent. Even if they are all the same, however, no two pickups have really identical operating characteristics. Thus, blender 10 affords a useful and simple yet inexpensive device for combining output signals from any two of the three pickups to produce a blend signal to drives amplifier 36 and speaker 37.

Figure 3:
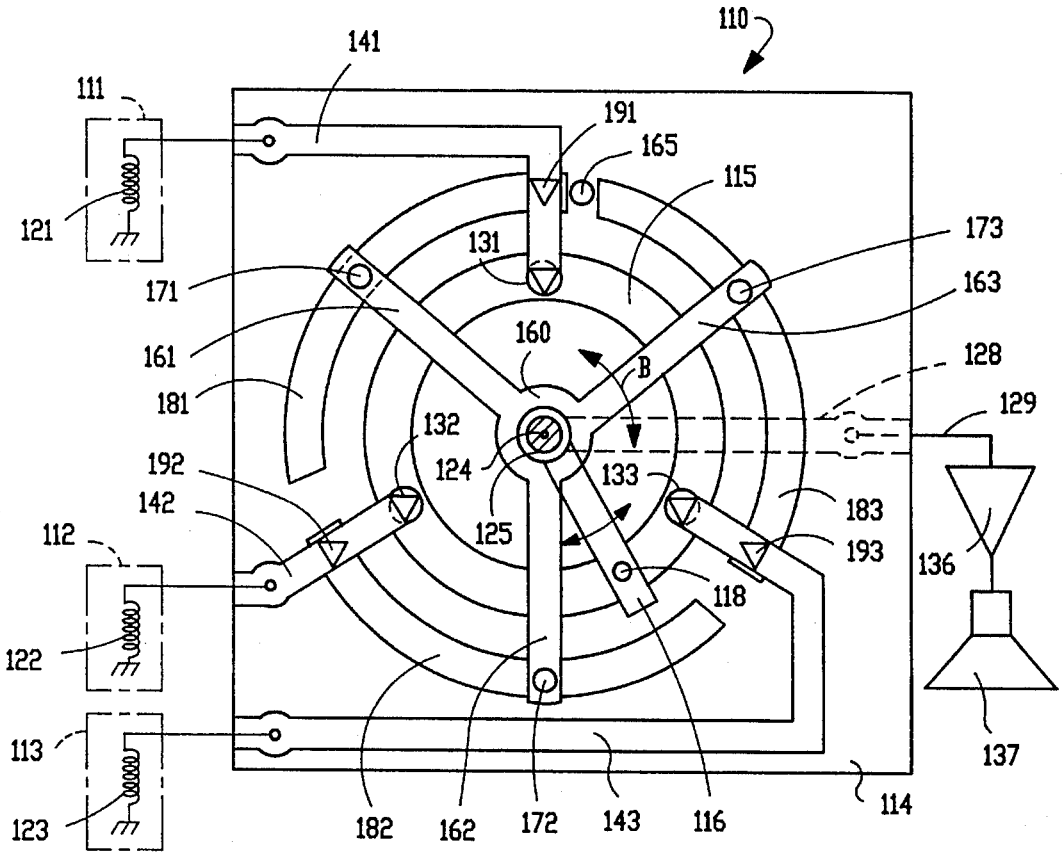
FIG. 3 is a plan view of a signal blender constructed in accordance with another embodiment of the invention.

FIG. 3 illustrates a signal blender 110 constructed in accordance with another embodiment of the invention. Device 110 is connected to the output coils 121, 122 and 123 of three musical instrument pickups 111, 112 and 113 respectively. Blender 110 includes a support 114, which again may be a small printed circuit board. On one surface of support 114 there is an annular main blending resistance 115 typically formed of a conductive polyfilm material having a resistance of 10 to 150 kilohms per square. There are three main connection taps or terminals 131, 132 and 133 located at equal angular displacements (120°) from each other around the annular main resistance 115, which is centered about an axis 124. Thus, there is one tap on the main resistance 115 for each of the three pickups 111, 112 and 113.

Signal blender 110 further comprises three main connection means 141, 142, and 143; each is preferably formed as a strip of conductor material deposited on the same surface of support 114 as main resistance 115. Connection means 141 provides an electrical connection from one end of coil 121 in pickup 111 to the first tap 131 on main resistance 115. Similarly, connections 142 and 143 connect taps 132 and 133, respectively, to one end of each of the pickup coils 122 and 123 of pickups 112 and 113. As before, the other terminal of each pickup coil is grounded.

In blender 110 there is a main electrically conductive contact 116 that is affixed to a shaft 125 centered on axis 124 so that contact 116 can be rotated clockwise or counter-clockwise as indicated by the arrows A. As before, movable contact 116 may be formed of a resilient electrically conductive material such as a thin, tempered bronze metal strip. A depression 118 in contact 116, aligned with the annular main resistance 115, provides an effective electrical connection from the main resistance to contact 116. Contact 116 is electrically connected to an output connection conductor 128 on the other surface of support 114. From conductor 128 there is a further conductor 129 that connects blender 110 to the input of an amplifier 136 that drives a speaker 137. As before, any controls for amplifier 136 and speaker 137 have been omitted from the drawing. It will be recognized that, as thus far described, blender 110 is essentially similar to the blender 10 of FIGS. 1 and 2.

Signal blender 110, FIG. 3, however, comprises three additional auxiliary resistances 181, 182 and 183. Each of these auxiliary resistances is of arcuate configuration with the three arcs having a center at axis 124. The clockwise end of auxiliary resistance 181 is electrically connected, at 191, to the connection means comprising conductor 141. There is a similar conductive connection 192 from connection means 142 to the clockwise end of auxiliary resistance 182. Another contact 193 connects conductor 143 to the clockwise end of auxiliary resistance 183. The other, counterclockwise, end of each of the auxiliary resistances 181, 182 and 193 is open circuited.

In signal blender 110 there is a three-armed auxiliary contact 160 that is rotatably mounted upon but electrically insulated from shaft 125. The three arms 161, 162 and 163 of auxiliary contact 161 are provided with contact elements 171, 172 and 173, respectively, to afford electrical connections to the auxiliary resistances 181, 182 and 183. Auxiliary contact 160 can be rotated about axis 124 as generally indicated by arrows B. A post 165 may be provided to limit rotational movement of contact 160 to slightly less than 120° so that each arm 163 is confined to electrical connection to one auxiliary resistance in signal blender 10.

Figure 3A:
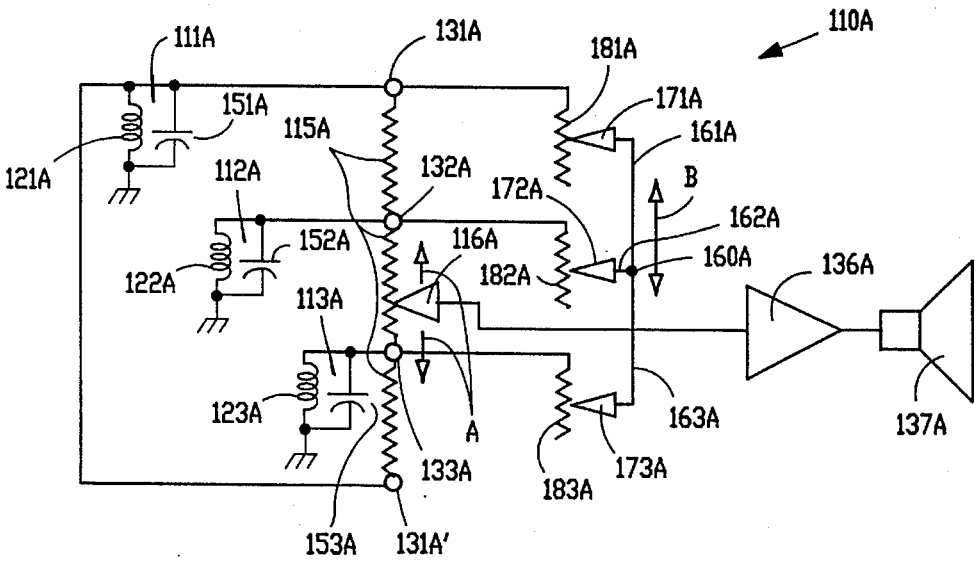
FIG. 3A is a schematic electrical diagram of an equivalent circuit for the blender of FIG. 3.

FIG. 3A affords an equivalent circuit diagram for blender 110 of FIG. 3. As in FIG. 1A, the circuit elements of blender 110 are shown with the same reference numerals in FIG. 3A as in FIG. 3 except that in the equivalent circuit diagram of FIG. 3A the letter "A" has been added to each reference numeral. The left hand portion of the equivalent circuit is the same as in FIG. 1A. The principal difference between the circuits of FIGS. 1A and 3A is the presence, in FIG. 3A, of the three auxiliary resistances 181A, 182A and 183A together with the arms 161A, 162A and 163A of the auxiliary contact member 160A. As before, in the equivalent circuit 110A all elements are shown in linear arrangement. The main contact 116A is movable in opposed directions as indicated by arrows A. The auxiliary contact 160A is movable in opposed directions as indicated by arrows B.

Blender 110, however, as shown in the equivalent circuit 110A of FIG. 3A, has one attribute that was not present in blender 10 of FIGS. 1 and 2. Thus, if the auxiliary movable contact 160A is moved to the upper extremity of its range of movement, its contacts 171A, 172A and 173A are all directly connected to taps 131A, 132A and 133A on the main resistance 115. That is, all of the operating coils of the musical instrument pickups are electrically connected to each other. As a consequence, at each of the taps 131A, 132A and 133A, there is an equal-amplitude input from each of the pickups. This way, the output signal to the amplifier 136A is a blend, with no appreciable attenuation, of the outputs (pickup signals) from the three pickups.

Movement of auxiliary contact 160 away from its uppermost position, in the equivalent circuit of FIG. 3A, however, changes this relationship when the auxiliary contact 160 (FIG. 3) is turned as far as it will go counterclockwise, corresponding to movement of contact 160A (FIG. 3A) to its lowest position, the main contact 116, FIG. 3, corresponding to 116A in FIG. 3A, has maximum control and really determines the contributions of the pickup signals to the blend signal supplied to amplifier 36 (or 36A). For intermediate positions of the auxiliary contact, the output is a proportional mix of the pickup signals. Thus, for the illustrated positions of auxiliary contact 160 and main contact 116, the output or blend signal is in the ratio of 60:30:10 for pickups 13, 12, and 11, respectively.

Figure 4:
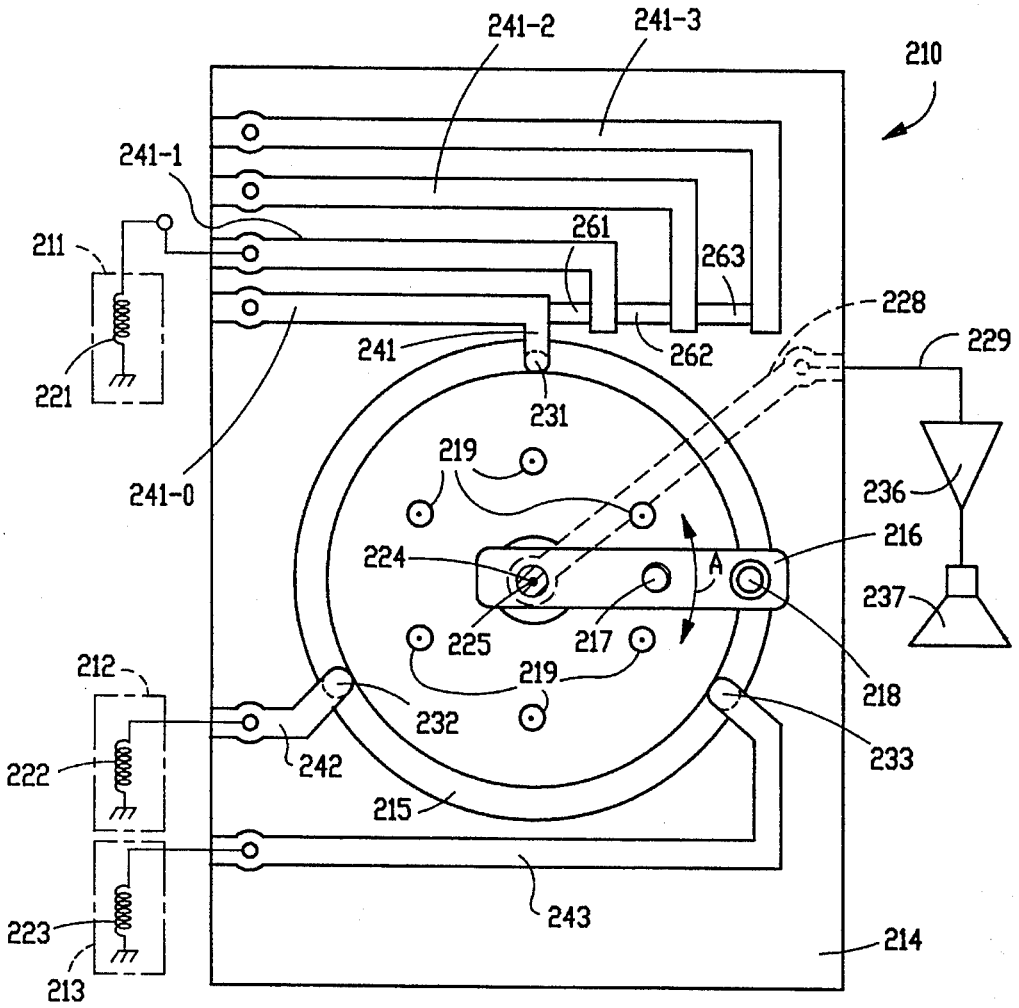
FIG. 4 is a plan view of a signal blender constructed in accordance with a further embodiment of the invention.

FIG. 4 illustrates, partly in schematic form, a signal blender 210 constructed in accordance with a further embodiment of the invention. Signal blender 210 is utilized to connect three electrical musical pickups 211, 212 and 213 to an amplifier 236 that drives a speaker 237 so that the blend signal supplied on conductor 229 to amplifier 236 affords a plurality of different combinations of the output signals from the operating coils 221, 222 and 223 of the pickups. The relative amplitudes of the pickup signals, in the blend signal supplied to amplifier 236, are subject to a wide variation in blender 210.

Blender 210 includes a main blending resistance 215 which constitutes a continuous, 360° ring of resistance material deposited upon one surface of a printed circuit board support 214. There are three main connection taps 231, 232 and 233 located at equi-angularly spaced locations around the ring resistance 215; that is, there is an angle of 120° between each pair of taps 231–233 relative to the axis 224 of the main resistance. The necessary electrical connections to the operating coils 222 and 223 of musical pickups 212 and 213 are the same as before and are provided by bands 242 and 243 of conductive material on the same surface of support 214 as resistance 215. However, in this construction the other main connection means is split into four elements 241-0, 241-1, 241-2 and 241-3. Conductive band 241-0 is connected directly to the main connection means 241 that leads to tap 231. Connection means 241, however, is connected to conductor 241-1 by a resistor 261. A resistor 262 connects conductive bands 241-1 and 241-2. Yet another resistor 263 connects the conductive strips 241-2 and 241-3. The operating coil 221 of pickup 211 is electrically connected to just one of the conductive strips 241-0 through 241-3; in FIG. 4 the coil is shown electrically connected to conductor 241-1. With the connections shown, resistor 261 is in the electrical circuit of the blender, interposed in series in the connection from coil 221 to tap 231. On the other hand, resistors 262 and 263 are not incorporated in the blender circuit.

In all other respects, blender 210 is essentially the same as blender 10 of FIGS. 1 and 2. Thus, there is a main rotatable conductive contact 216 having a contact 218 that engages the main resistance comprising ring 215. Contact 216 has a male detent element 217 projecting toward base 214 and is pivotally mounted upon a shaft 225 that rotates, clockwise or counter-clockwise about the axis 224; see arrows A. There are a series of female detents (depressions) 219 in the surface of printed circuit board support 214; these detent depressions 219 are engageable by the detent projection 217 on contact 216. The output connection 228 of blender 210 is electrically connected to contact 216 through shaft 225 and has an electrical connection to the conductor 229 that leads to the input of amplifier 236.

Figure 4A:
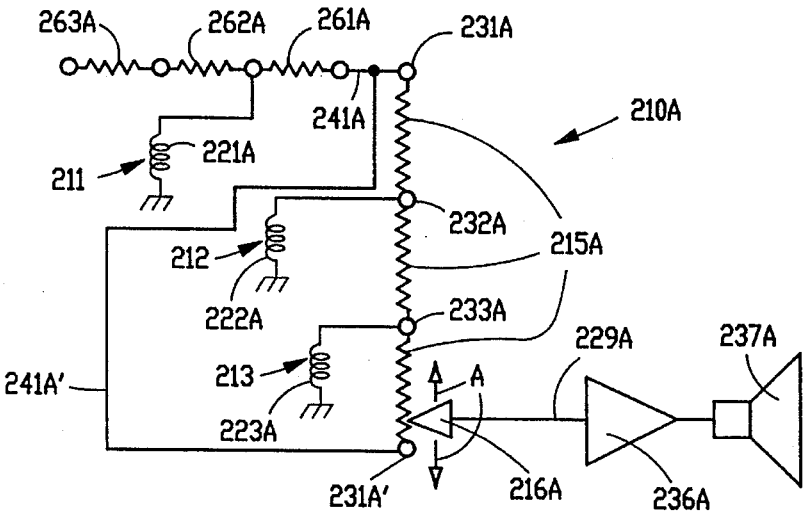
FIG. 4A is a schematic electrical diagram of an equivalent circuit for the blender of FIG. 4.

FIG. 4A affords an equivalent circuit diagram 210A for blender 210. In the equivalent circuit 210A of FIG. 4 the circuit elements shown are the same as those in the equivalent circuit of FIG. 1A except for the presence of resistors 261A, 262A and 263A, all connected in series by conductors 241-0A through 241-3A.

Operation of blender 210 is essentially the same as described above for blender 10 except that the construction illustrated in FIG. 4 provides for selective attenuation of the pickup signal from device 211. As illustrated, this pickup signal is reduced in amplitude because it is required to traverse resistor 261 before it is connected to the main blender resistance 215 through connection 241 and tap 231. Referring to the equivalent circuit of FIG. 4A, it is seen that resistance 261A is effectively connected in series between coil 221 and the two terminals 231A and 231A' that represent, in the equivalent circuit, the one tap 231 in the construction shown in FIG. 4. Inasmuch as the operation is the same, apart from the additional attenuation introduced by resistor 261, there is no necessity to repeat the operational description. The user of blender 210 selects a connection to coil 221 of pickup 211 so that the first pickup signal is supplied to resistance 215 at full amplitude or with a reduction in amplitude afforded by the presence of one, two, or three resistors in series between the pickup and the blender resistance tap.

Figure 5:
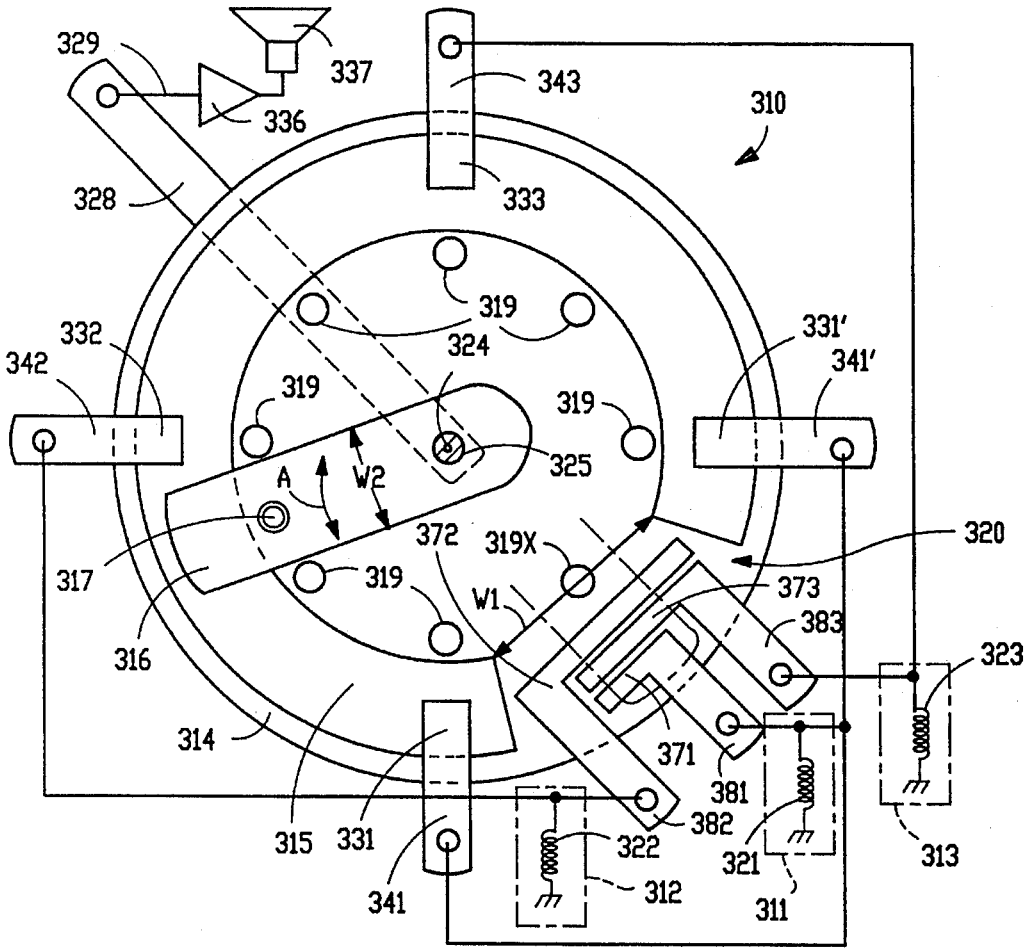
FIG. 5 is a plan view of a signal blender constructed in accordance with yet another embodiment of the invention.

FIG. 5 illustrates, partly in schematic, a signal blender 310 constituting yet another preferred embodiment of the invention. Signal blender 310 blends signals from three electrical musical pickups 311, 312, and 313, and supplies the blend signal, via a conductor 329, to an amplifier 336 to drive a speaker 337. Device 310 combines the pickup signals from the operating coils 321, 322, and 323 of pickups 311–313 in different combinations and in varying amplitudes, depending on the needs and desires of a musical instrument player.

In blender device 310 there is a main blending resistance 315 which is formed as an arcuate deposit of resistance material on one surface of a support 314. In FIG. 5 support 314 is shown as a circular segment of printed circuit board material having a center axis 324 which is also the axis of the arcuate main blending resistance 315. Unlike previously described embodiments however, resistance 315 is not a complete 360° circle. Instead, the resistance ring 315 is less than 360°; as shown it is approximately 300° with the ends of the resistance ring separated by a gap 320 of about 60°. At its narrowest point gap 320 has a width W1.

Three main connection taps 331, 332 and 333 are electrically conductively connected to equi-angularly spaced points around the main resistance ring 315. Because resistance 315 is appreciably less than 360°, taps 331–333 are spaced by 90° arcs, starting at the bottom of ring 315 and proceeding clockwise as seen in FIG. 5. There is a fourth tap 331' on ring 315, 90° from tap 333; this fourth tap 331' is electrically connected to tap 331. Electrical connections to the operating coils 322 and 323 of pickups 312 and 313 are provided by conductive tabs 342 and 343 projecting from and conductive strips 332 and 33 on the same surface of support 314 as the main blending resistance 315. There are two additional similar conductive tabs 341 and 341', both connected to one end of the coil 321 of pickup 311.

Blender 310, FIG. 5, further comprises a rotatable conductive main contact 316 mounted on a shaft 325 concentric with axis 324; contact 316 engages the main resistance 315 of the blender device. A male detent element 317 projects from contact 316 toward base 314 at a location inside of the inner edge of ring 315. A series of detent depressions 319 in support 314 are engageable by the male detent element 317 to position contact 316 at any of seven 45° positions around resistance ring 315. There is an eighth detent depression 319X aligned with the center of gap 320. The output connection 328 for blender 310 can be a conductive strip electrically connected at one end to contact 316 through shaft 325; the other end of strip 328 is a projecting conductive tab electrically connected to the conductor 329 that supplies the blended output signal to amplifier 336.

The gap 320 in blender 310 is not empty. In that gap there are three electrically conductive taps 371, 372 and 373; each of these taps 371, 372 and 373 has a connector portion (381, 382 and 383) that projects outwardly from support 314. Each connector 381–383 is connected to a respective one of the pickup output coils 321, 322, and 323. Thus, one end of coil 321 is electrically connected to all of the three connectors 341, 341' and 381. One end of coil 322 is electrically connected to both of the connection means 342 and 382; one end of coil 323 is connected electrically to the connection means 343 and 383. The other end of each of the pickup coils is grounded.

In blender 310, FIG. 5, provision may be made for connection of individual capacitors from each of the taps 371–373 to ground. The capacitor arrangement may be like that shown in FIG. 1. The capacitor connections have been omitted in FIG. 5 to avoid over-crowding.

The width W2 of movable contact 316, in blender 310 of FIG. 5, should be sufficient so that when the rotatable output contact is in position 316X, engaging detent depression 319X, member 316 is in electrical contact with all three of the taps 371–373.

Figure 5A:
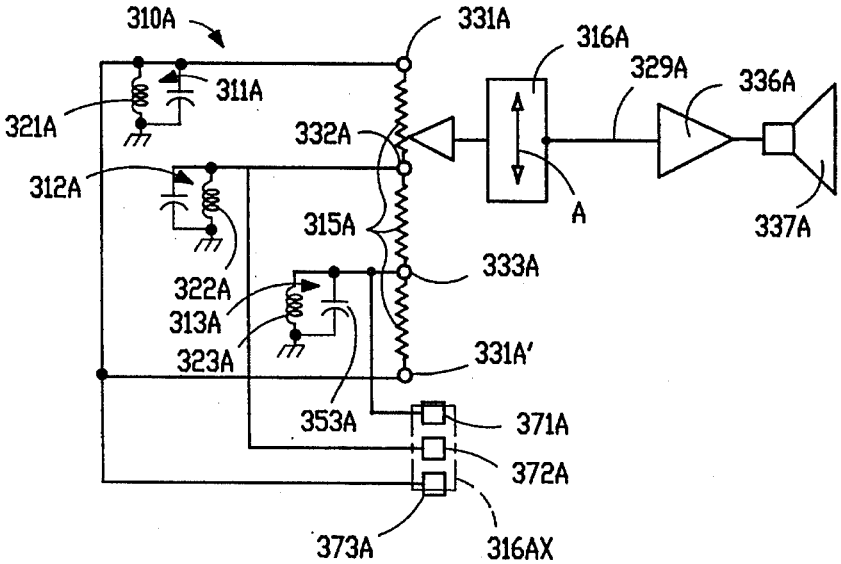
FIG. 5A is a schematic electrical diagram of an equivalent circuit for the blender of FIG. 5.

FIG. 5A is equivalent electrical circuit 310A representative of blender 310 of FIG. 5. FIG. 5A includes the principal circuit elements for the blender and associated devices, specifically pickups 311A–313A, their coils 321A–323A, main resistance 315A and its taps 331A, 332A, 333A and 331A', taps 371A–373A, movable contact 316A; output connection 328A and 329A, amplifier 336A and speaker 337A. Operation is the same as for previously described embodiments of the invention except that blender 310 (FIG. 5) has a specific detent position 319X for a direct blending of the output signals from all three pickups 311–313, without attenuation. Thus, when contact 316 is in position 316X, FIG. 5A it is electrically connected directly to all of the pickups; the same situation obtains in the equivalent circuit 310A of FIG. 5A when movable contact 316 is moved down to position 316AX.

I claim:

1. A signal blender for blending the pickup signals generated by at least three musical instrument pickups in a plurality of different combinations and in a multiplicity of different amplitudes to develop a blend signal, the signal blender comprising:

a continuous main blending resistance having at a plurality of main connection taps, at least one for each pickup;

a plurality of main connection means, at least one main connection means for each pickup, connecting each pickup to at least one main resistance connection tap;

a main movable electrically conductive contact, engageable in electrical contact with the main resistance at any point on the main resistance to derive a blend signal therefrom; and output connection means connecting the main movable contact to an output circuit to apply the blend signal to the output circuit.

2. A signal blender according to claim 1 in which:

the main resistance is an arcuate element of conductive resistance material, concentric about a given axis and having a given minimum displacement from that axis, deposited on one surface of an insulator support; and the movable contact is a rotary conductive contact rotatable about the main resistance axis and having a length greater than the minimum displacement for the main resistance.

3. A signal blender according to claim 2 and further comprising:

a first detent member on the main movable contact;

a plurality of second detent members, on the support at arcuately spaced locations around the axis; and the first detent member is engageable with any one of the second detent members to locate the main movable contact at a predetermined orientation relative to the main resistance.

4. A signal blender according to claim 3 in which:

the first detent member is formed integrally with the main movable contact; and the second detent members are each formed integrally with the support.

5. A signal blender according to claim 4 in which:

the first detent member is a male detent member projecting from the main movable contact toward the support; and each second detent member is a recess in the surface of the support facing toward and engageable by the first detent member.

6. A signal blender according to claim 3 in which all detent members are spaced by a predetermined distance from the axis and that predetermined distance is less than the minimum displacement of the main resistance from the axis.

7. A signal blender according to claim 2 and further comprising:

a ground contact of conductive material deposited on a surface of the insulator support;

a plurality of capacitors, one for each pickup;

and means connecting each capacitor from the ground contact to one of the main connection means.

8. A signal blender according to claim 2 in which the support is a printed circuit insulator support.

9. A signal blender according to claim 2 in which the main movable contact is a conductive member formed of a resilient conductive spring metal, mounted on a shaft having an axis coinciding with the axis of the main resistance.

10. A signal blender according to claim 2 in which the main resistance is a complete, continuous, 360° ring.

11. A signal blender according to claim 10 in which the signal blender has three main connection taps located at 120° intervals around the main resistance ring, and in which the blender is connected to three pickups.

12. A signal blender according to claim 2, for connection to N pickups, and further comprising:

a plurality of arcuate independent auxiliary resistances deposited on the surface of the insulator support in a concentric array around the main resistance, each auxiliary resistance having one end electrically connected to one main connection tap; and an auxiliary movable electrically conductive contact having N contact arms each engageable in electrical contact with one of the auxiliary resistances, the auxiliary contact being rotatable about the axis of the main resistance.

13. A signal blender according to claim 12 in which the only electrical connection between the main movable contact and the auxiliary movable contact is through the auxiliary and main resistances.

14. A signal blender according to claim 2 in which:

at least one of the main connection means includes a plurality of amplitude-reducing resistances connectable in series between one pickup and one main connection tap.

15. A signal blender according to claim 14 and further comprising:

a first detent member on the main movable contact;

a plurality of second detent members, on the support at arcuately spaced locations around the axis; and the first detent member is engageable with any one of the second detent members to locate the main movable contact at a predetermined orientation relative to the main resistance.

16. A signal blender according to claim 2 in which the main resistance is an arcuate ring having a gap of preselected width between the ends of the ring, and in which the main movable contact has a given width narrower than the gap between the ends of the ring, the blender further comprising:

a plurality of direct pickup contacts on the one surface of the insulator support, aligned in the gap between the ends of the main resistance ring, all of the direct pickup contacts being engageable simultaneously by the main movable contact; and a plurality of direct connection means each connecting one direct pickup contact to one pickup.

17. A signal blender according to claim 16, in which the number of main connection taps exceeds the number of pickups by one, and in which two of the main connection taps are located adjacent opposite ends of the main resistance and are electrically connected to each other.

18. A signal blender according to claim 17 and further comprising:

a first detent member on the main movable contact;

a plurality of second detent members, on the support at arcuately spaced locations around the axis; and the first detent member is engageable with any one of the second detent members to locate the main movable contact at a predetermined orientation relative to the main resistance.

19. A signal blender according to claim 17 and further comprising:

a ground contact of conductive material deposited on a surface of the insulator support;

a plurality of capacitors, one for each pickup;

and means connecting each capacitor from the ground contact to one of the main connection means.

20. A signal blender according to claim 17, in which the main resistance has an arcuate length of about 300°.

* * * * *